US009824650B2

(12) United States Patent
Zhang et al.

(10) Patent No.: US 9,824,650 B2
(45) **Date of Patent: *Nov. 21, 2017**

(54) METHOD OF ADJUSTING DISPLAY UNIT AND ELECTRONIC DEVICE

(71) Applicants: BEIJING LENOVO SOFTWARE LTD., Beijing (CN); LENOVO (BEIJING) LIMITED, Beijing (CN)

(72) Inventors: Zhenhua Zhang, Beijing (CN); Ke Shang, Beijing (CN)

(73) Assignees: BEIJING LENOVO SOFTWARE LTD., Beijing (CN); LENOVO (BEIJING) LIMITED, Beijing (CN)

( * ) Notice: Subject to any disclaimer, the term of this patent is extended or adjusted under 35 U.S.C. 154(b) by 22 days.

This patent is subject to a terminal disclaimer.

(21) Appl. No.: 14/227,796

(22) Filed: Mar. 27, 2014

(65) Prior Publication Data

US 2014/0368483 A1 Dec. 18, 2014

(30) Foreign Application Priority Data

Jun. 14, 2013 (CN) ..... 2013 1 0236594

(51) Int. Cl.
*G09G 5/02* (2006.01)
*G09G 3/36* (2006.01)

(52) U.S. Cl.
CPC ... *G09G 3/3611* (2013.01); *G09G 2320/0626* (2013.01); *G09G 2320/0666* (2013.01); *G09G 2360/144* (2013.01)

(58) Field of Classification Search
None
See application file for complete search history.

(56) References Cited

U.S. PATENT DOCUMENTS

| | | | | |
|---|---|---|---|---|
| 7,016,539 | B1 * | 3/2006 | Silver | G06K 9/481 382/216 |
| 2003/0011563 | A1 * | 1/2003 | Wada | H04N 9/73 345/156 |
| 2003/0020725 | A1 * | 1/2003 | Matsuda | G09G 5/00 345/600 |
| 2004/0070565 | A1 * | 4/2004 | Nayar | G06K 9/4661 345/156 |

(Continued)

FOREIGN PATENT DOCUMENTS

| | | | |
|---|---|---|---|
| CN | 101587703 | A | 11/2009 |
| CN | 101604516 | A | 12/2009 |
| CN | 102479499 | A | 5/2012 |

*Primary Examiner* — Anh-Tuan V Nguyen

(57) ABSTRACT

A method for an electronic device with a display unit and an electronic device are provided. The method may comprise: obtaining an environmental parameter under an environment where the electronic device is disposed when the display unit is in a first display status, the environmental parameter including at least an environmental color temperature parameter of the environment and configured for adjusting the display status of the display unit; determining whether to adjust the display status based on at least the environmental color temperature parameter included in the environmental parameter to get a first determination result; and adjusting the display status from the first display status to a second display status different from the first display status if the first determination result indicates that it is to adjust the display status.

4 Claims, 2 Drawing Sheets

(56) References Cited

U.S. PATENT DOCUMENTS

2004/0164950 A1* 8/2004 Cabrera ..... G02B 26/004 345/107
2004/0263512 A1* 12/2004 Santodomingo ..... G06T 15/00 345/428
2005/0149864 A1* 7/2005 Matsuzaki ..... G09G 5/02 715/202
2005/0185837 A1* 8/2005 Takano ..... H04N 1/4072 382/162
2005/0212824 A1* 9/2005 Marcinkiewicz .... G09G 3/3406 345/690
2007/0052735 A1* 3/2007 Chou ..... 345/690
2007/0165048 A1* 7/2007 Yamashita ..... G06T 5/009 345/601
2008/0266316 A1* 10/2008 Takahashi ..... G09G 5/02 345/590
2008/0303918 A1* 12/2008 Keithley ..... 348/223.1
2008/0309612 A1* 12/2008 Gormish ..... G02F 1/167 345/105
2009/0067711 A1* 3/2009 Sasaki ..... H04N 9/73 382/167
2009/0195670 A1* 8/2009 Koishi ..... G06T 15/50 348/223.1
2009/0256929 A1* 10/2009 Ishii ..... H04N 1/6088 348/223.1
2010/0020117 A1* 1/2010 Tanizoe ..... G09G 5/005 345/690
2010/0302222 A1* 12/2010 Chen ..... G01J 1/10 345/207
2010/0309095 A1* 12/2010 Chang ..... G09G 3/20 345/3.1
2011/0148835 A1* 6/2011 Yamazaki ..... G02F 1/13318 345/207
2012/0050307 A1* 3/2012 Mahowald ..... H05B 37/0218 345/590
2012/0134584 A1* 5/2012 Kondo ..... H04N 1/608 382/167
2012/0268437 A1* 10/2012 Lee ..... G09G 3/20 345/207
2012/0293473 A1* 11/2012 Lee ..... G09G 5/00 345/207
2013/0076974 A1* 3/2013 Atkins ..... H04N 5/235 348/362
2013/0088523 A1* 4/2013 Wu ..... G09G 3/3611 345/690
2013/0169826 A1* 7/2013 Ferguson ..... H04N 17/02 348/191
2013/0314341 A1* 11/2013 Lee ..... G06F 3/0488 345/173
2013/0332843 A1* 12/2013 Boettcher ..... G06F 3/0481 715/744
2014/0002428 A1* 1/2014 Letourneur ..... G09G 3/34 345/207
2014/0078135 A1* 3/2014 Ka Yan ..... G06T 15/10 345/419
2014/0078165 A1* 3/2014 Messmer ..... H04N 1/603 345/589
2014/0132628 A1* 5/2014 Hoff, III ..... G06T 15/50 345/633
2014/0204023 A1* 7/2014 Kumar ..... G06K 9/00671 345/156
2014/0253780 A1* 9/2014 Shih ..... G01J 1/4204 348/335
2014/0285477 A1* 9/2014 Cho ..... G09G 3/2003 345/207
2015/0170604 A1* 6/2015 Iwagaki ..... B64D 11/00 345/589

* cited by examiner

METHOD OF ADJUSTING DISPLAY UNIT AND ELECTRONIC DEVICE

TECHNICAL FIELD

The present disclosure generally relates to the electronic display field, and more particularly, to a method of adjusting a display unit and an electronic device.

BACKGROUND

With continuous development in technology, electronic devices are also rapidly developing. An increasing number of different types of electronic products have emerged, and customers enjoy various convenient and comfortable life brought by them. For example, various displays are coming into sight. Furthermore, those displays, instead of paper, have become an object which we view for the longest time. Existing liquid crystal displays (LCDs) are mostly commonly used, and are planar ultra-thin display apparatus. The LCD comprises a number of colorful or monochrome pixels in front of a light source or a reflector. The LCD has low power consumption, and functions based on a fundamental principle that liquid crystal molecules are stimulated by currents to generate dots, lines or surfaces, together with a back light, to constitute an image.

The greatest advantage of the LCD is color expressivity. The LCD panel is composed of, for example, 1024×768 pixels to display an image, and each of the pixels has its color controlled based on three primary colors of red, green and blue (R, G, B). Each of the primary colors (R, G, B) has 6 bits, i.e. 64 expressivities, and thus each individual pixel can express 64×64×64=262144 colors. Further, a Frame Rate Control (FRC) technique may be utilized to express a full color image in a simulated manner. In this case, each primary color uses 8 bits, i.e. 256 expressivities, and thus each individual pixel can express 256×256×256=16777216 colors.

However, the inventors found that there may be some problems.

The existing displays are rich in color expressivities, and the expression of the colors is not susceptible to change. However, in the actual world, the colors of a practical object perceived by human eyes are changed when environmental light is changed. Thus, there is such a problem in the displays that a displayed object can't be changed with the change of the environmental light. As a result, a user may perceive an incorrect or distorted image. Thus, the user's experiences are degraded.

SUMMARY

According to embodiments of the present disclosure, there is provided a method of adjusting a display unit and an electronic device, to address the problem that an object displayed on a display can't change with change of environmental light under an environment where a user is located, and thus to adaptively adjust the object displayed by the display with the change of the environmental light according to adaptability of human eyes to the environment, so that the user has a better experience.

According to an aspect of the present disclosure, there is provided a method for an electronic device with a display unit. The method may comprise: obtaining an environmental parameter under an environment where the electronic device is disposed when the display unit is in a first display status, the environmental parameter including at least an environmental color temperature parameter of the environment and configured for adjusting the display status of the display unit; determining whether to adjust the display status based on at least the environmental color temperature parameter included in the environmental parameter to get a first determination result; and adjusting the display status from the first display status to a second display status different from the first display status if the first determination result indicates that it is to adjust the display status.

Obtaining the environmental parameter may comprise: obtaining the environmental parameter by an environment detection device provided in the electronic device. The environmental parameter may further comprise a brightness parameter and a chromaticity parameter.

After obtaining the environmental parameter, the method may further comprise: simulating a first status characteristic of a first object displayed on the display unit corresponding to the environmental parameter based on the environmental parameter.

The environmental parameter may comprise the color temperature parameter, and simulating the first status characteristic may comprise: simulating a first color temperature characteristic of the first object corresponding to the color temperature parameter. Alternatively, the environmental parameter may comprise a brightness parameter, and simulating the first status characteristic may comprises: simulating a first brightness characteristic of the first object corresponding to the brightness parameter. Or alternatively, the environmental parameter may comprise a chromaticity parameter, and simulating the first status characteristic may comprise: simulating a first chromaticity characteristic of the first object corresponding to the chromaticity parameter.

Determining whether to adjust the display status may comprise: determining whether the first status characteristic matches the first display status to get the first determination result, wherein the first determination result indicates that it is to adjust the display status if there is no matching, and indicates that it is not to adjust the display status if there is matching.

Adjusting the display status from the first display status to the second display status may comprise: obtaining target display adjusting data corresponding to the first status characteristic based on the first status characteristic; recording the display adjusting data in a display status recording table in a storage device of the electronic device; and adjusting first display adjusting data corresponding to the first display status to the target display adjusting data based on the target display adjusting data in the display status recording table, so that the display status is adjusted from the first display status to the second display status corresponding to the target display adjusting data.

According to another aspect of the present disclosure, there is provided an electronic device. The electronic device may comprise: a display unit; a first obtaining module configured to obtain an environmental parameter under an environment where the electronic device is disposed when the display unit is in a first display status, the environmental parameter including at least an environmental color temperature parameter of the environment and configured for adjusting the display status of the display unit; a first determining module configured to determine whether to adjust the display status based on at least the environmental color temperature parameter included in the environmental parameter to get a first determination result; and a first adjusting module configured to adjust the display status from the first display status to a second display status different from the first display status if the first determination result indicates that it is to adjust the display status.

The first obtaining module may comprise an environment detection device provided in the electronic device and configured to obtain the environmental parameter. The environmental parameter may further comprise a brightness parameter and a chromaticity parameter.

The electronic device may further comprise a first simulating module configured to simulate a first status characteristic of a first object displayed on the display unit corresponding to the environmental parameter based on the environmental parameter.

The first simulating module may comprise: a color temperature simulating subunit configured to simulate a first color temperature characteristic of the first object corresponding to the color temperature parameter if the environmental parameter comprises the color temperature parameter; a brightness simulating subunit configured to simulate a first brightness characteristic of the first object corresponding to a brightness parameter if the environmental parameter comprises the brightness parameter; and a chromaticity simulating subunit configured to simulate a first chromaticity characteristic of the first object corresponding to a chromaticity parameter if the environmental parameter comprises the chromaticity parameter.

The first determining module may be configured to: determine whether the first status characteristic matches the first display status to get the first determination result, wherein the first determination result indicates that it is to adjust the display status if there is no matching, and indicates that it is not to adjust the display status if there is matching.

The first adjusting module may comprise: a first obtaining subunit configured to obtain target display adjusting data corresponding to the first status characteristic based on the first status characteristic if the first determining result indicates that it is to adjust the display status; a recording unit configured to record the display adjusting data in a display status recording table in a storage device of the electronic device; and a first adjusting subunit configured to adjust first display adjusting data corresponding to the first display status to the target display adjusting data based on the target display adjusting data in the display status recording table, so that the display status is adjusted from the first display status to the second display status corresponding to the target display adjusting data.

According to one or more embodiments of the present disclosure, there can be the following effects or advantages.

The environmental parameter under the environment where the electronic device is disposed when the display unit is in the first display status may be obtained, wherein the environmental parameter may include at least the environmental color temperature parameter of the environment and configured for adjusting the display status of the display unit. Then, the display status of the electronic device may be adjusted based on the environmental parameter. As a result, it is possible to effectively address the problem that the object displayed on the display can't change with the change of the environmental light, and thus to adaptively adjust the display status the electronic device with the change of the environmental light.

Further, the first status characteristic of the first object displayed on the display unit corresponding to the environmental parameter may be simulated based on the environmental parameter. As a result, it is possible to effectively address the problem that the object displayed on the display can't truly reflect the change of colors as a real object when the environmental light changes, and thus to adjust the display status of the electronic device by simulating the color change of the real object in the environment.

DETAILED DESCRIPTION

Figure 1:
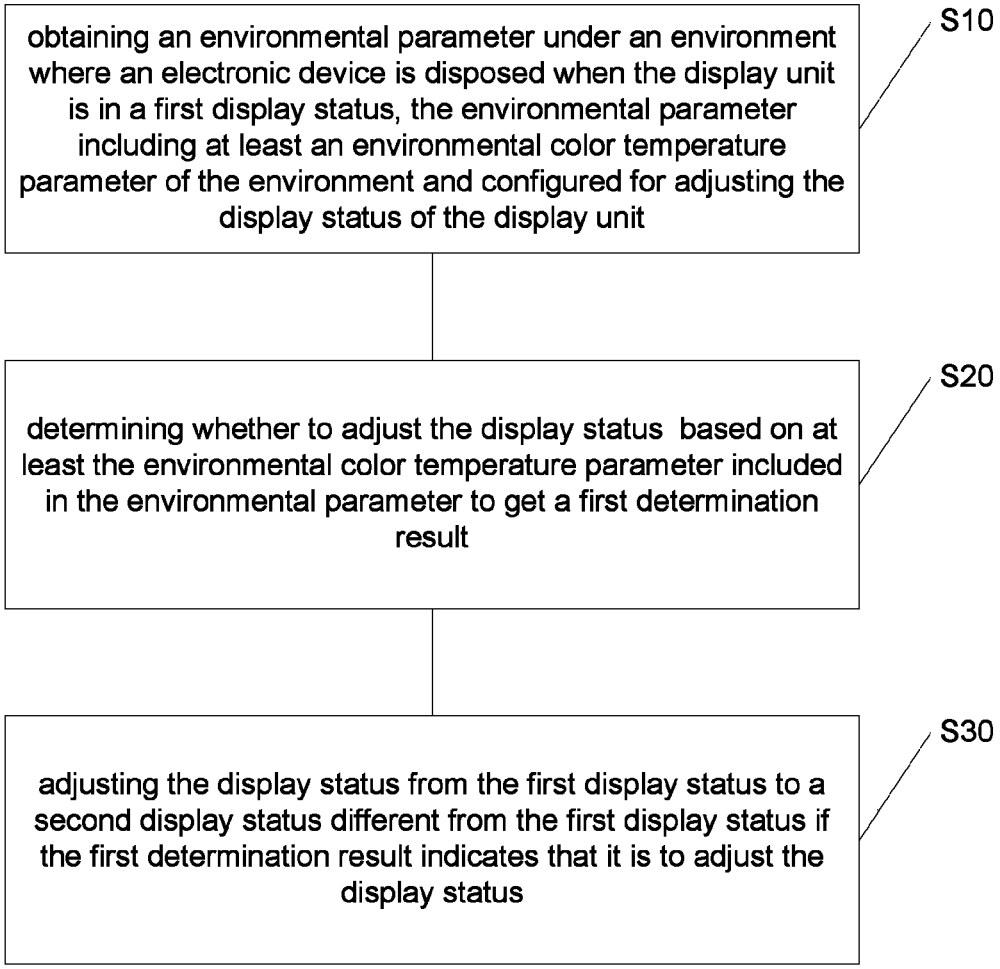
FIG. 1 is a flowchart schematically showing a method of adjusting a display unit according to an embodiment of the present disclosure.
Figure 2:
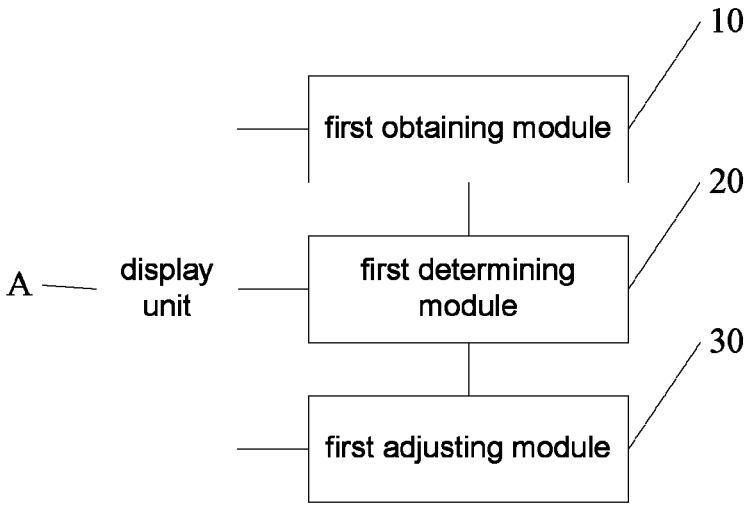
FIG. 2 is a block diagram schematically showing an electronic device according to an embodiment of the present disclosure.

According to embodiments of the present disclosure, there is provided a method of adjusting a display unit, to address the problem that an object displayed on a display can't change with change of environmental light under an environment where a user is located, and thus to adaptively adjust the object displayed by the display with the change of the environmental light according to adaptability of human eyes to the environment, so that the user has a better experience.

For example, a display status of a display unit of an electronic device may be detected as a first display status. Then, an environmental parameter under an environment where the electronic device is disposed may be detected to obtain an environmental parameter including at least an environmental color temperature parameter. Based on the environmental color temperature parameter included in the environmental parameters, it may be determined whether to adjust the first display status of the electronic device. If it is determined to adjust the first display status of the electronic device, the first display status may be adjusted from the current first display status to a second display status different from the first display status, so that the second display status adapts to the current environment of the electronic device and the second display status is suitable for a user to view.

In order to better understand the technology disclosed herein, some embodiments thereof will be described in detail with reference to the attached drawings.

According to an embodiment of the present disclosure, there is provided a method for an electronic device with a display unit. The electronic device may comprise a smart TV, a tablet computer, a notebook computer, a smart mobile phone and the like. The method may comprise: operation S10 of obtaining an environmental parameter under an environment where the electronic device is disposed when the display unit is in a first display status, the environmental parameter including at least an environmental color temperature parameter of the environment and configured for adjusting the display status of the display unit; operation S20 of determining whether to adjust the display status based on at least the environmental color temperature parameter included in the environmental parameter to get a first determination result; and operation S30 of adjusting the display status from the first display status to a second display status different from the first display status if the first determination result indicates that it is to adjust the display status.

The operation S10 of obtaining the environmental parameter may comprise: obtaining the environmental parameter by an environment detection device provided in the electronic device. The environmental parameter may further comprise a brightness parameter and a chromaticity parameter.

Here, an example where the electronic device comprises a smart TV is exemplified. When the smart TV is displaying an image on its display unit, it may record the current display status. For example, the current display status may comprise a first display status with a medium brightness, a good chromaticity and a color temperature of, for example, 6500K. The environment detection device provided in the smart TV is generally always in a detection status. For example, the environment detection device may comprise a photo sensor. Thus, the photo sensor may detect the change of the environmental light at all times. For example, at daytime, the sunlight is enough and thus the light is bright, so the photo sensor detects that the environmental parameter during some periods at daytime will be a strong brightness, a medium chromaticity and a color temperature of, for example, 7000K. On the other hand, at night, there is no any other natural light but the moonlight and thus the light is dark, so the photo sensor detects that the environmental parameter during some periods at night will be a dark brightness, a lower chromaticity and a color temperature of, for example, 4100K. Further, when a fluorescent lamp is lighting at night, the brightness in the environment will be slightly greater than that with only the moonlight but is significantly darker than that at daytime. Under the environment where the fluorescent lamp is lighting, the environmental chromaticity will be better than that with only the moonlight but worse than that at daytime, and the environmental color temperature will be, for example, around 5000K.

The terms of "chromaticity" and "color temperature" mentioned above are different from each other. The chromaticity represents color tone and saturation, and particularly, the class of color and the purity of color. The color temperature is a representation for spectral components of white light. The humans' eyes have different color senses for light with different color temperatures. The higher the color temperature is, it is perceived as more shifting to blue; and the lower the color temperature is, it is perceived as more shifting to red.

The change of the environment comprises not only the change between the daytime and the night, but also other changes. For example, the brightness, chromaticity and color temperature at different moments of the daytime may be different due to different irradiation angles of the sunlight.

After obtaining the environmental parameter, the method may further comprise: simulating a first status characteristic of a first object displayed on the display unit corresponding to the environmental parameter based on the environmental parameter.

If the environmental parameter comprises the color temperature parameter, simulating the first status characteristic may comprise: simulating a first color temperature characteristic of the first object corresponding to the color temperature parameter. Alternatively, if the environmental parameter comprises a brightness parameter, simulating the first status characteristic may comprise: simulating a first brightness characteristic of the first object corresponding to the brightness parameter. Alternatively, if the environmental parameter comprises a chromaticity parameter, simulating the first status characteristic may comprise: simulating a first chromaticity characteristic of the first object corresponding to the chromaticity parameter.

Again, reference may be made to the above example of the smart TV. Assume that the smart TV is displaying an electronic document. Of course, the electronic document may be displayed by a smart mobile phone or a tablet computer. At this point, a first status characteristic of a paper sheet may be simulated based on the environmental parameter obtained as above, for example, the bright brightness, the medium chromaticity and the color temperature of 7000K at noon. The first status characteristic indicates a display state that the real paper sheet should present to the user under the environment if the paper sheet, instead of the smart TV, displays the electronic document under the environment. The status characteristic may comprise a brightness, a chromaticity and/or a color temperature adapted to the environment.

The present disclosure is not limited to the above example of the electronic document displayed on the display unit of the smart TV. For example, an image including a person or a scene may be displayed.

After obtaining the first status characteristic which simulates the object, the operation S20 of determining whether to adjust the display status based on at least the environmental color temperature parameter included in the environmental parameter to get the first determination result may be carried out. Determining whether to adjust the display status may comprise: determining whether the first status characteristic matches the first display status to get the first determination result. The first determination result may indicate that it is to adjust the display status if there is no matching, and indicate that it is not to adjust the display status if there is matching.

Again, reference may be made to the above example of the smart TV displaying the electronic document. As described above, the environmental parameter under the current external environment may have been obtained, and the first status characteristic of the simulated object under the environmental parameter may have been obtained. Then, the first status characteristic may be compared with the first display status of the electronic document originally displayed on the smart TV. For example, the first status characteristic with the bright brightness, the medium chromaticity and the color temperature of 7000K which would be presented to the user by the simulated paper sheet under the environment may be compared with the first display status of the electronic document displayed on the smart TV, which may be the medium brightness, the good chromaticity and the color temperature of 6500K. Thus, it may be found that the first display status for the electronic document includes the brightness weaker than that of the real paper sheet under the current environment, the chromaticity higher than that of the real paper sheet under the current environment and the color temperature lower than that of the real paper sheet under the current environment. On the basis of the above analysis, it may be determined that the first display status of the electronic document does not match the first status characteristic of the paper sheet under the environment. The result indicates that it is to adjust the first display status of the electronic document. If, otherwise, the first status characteristic of the paper sheet matches the first display status of the electronic document under the current environment, the result will indicate that it is not to adjust the first display status of the electronic document.

In order to make the electronic document perceived by the user look like the real paper sheet, the first display status of the electronic document displayed on the smart TV may be adjusted if the displaying effect of the electronic document does not matches that of the real paper sheet.

The step S30 of adjusting the display status from the first display status to the second display status different from the first display status may be carried out if the first determination result indicates that it is to adjust the display status.

Adjusting the display status from the first display status to the second display status may comprise: obtaining target display adjusting data corresponding to the first status characteristic based on the first status characteristic; recording the display adjusting data in a display status recording table in a storage device of the electronic device; and adjusting first display adjusting data corresponding to the first display status to the target display adjusting data based on the target display adjusting data in the display status recording table, so that the display status is adjusted from the first display status to the second display status corresponding to the target display adjusting data.

Reference may be still made to the above example. The target display adjusting data for the first display status which does not match the first status characteristic may be determined according to the first status characteristic of the real paper sheet under the current environment. For example, it is found during the operation of determining whether to adjust the display status that the brightness of the first display status for the electronic document is lower than that of the real paper sheet under the current environment, then the target display adjusting data may indicate adjusting the brightness of the first display status for the electronic document (in a direction towards higher brightness), adjusting the chromaticity of the first display status for the electronic document (in a direction towards lower chromaticity) and adjusting the color temperature of the first display status for the electronic document (in a direction towards higher color temperature). The first display status for the electronic document may be adjusted based on the target display adjusting data indicating the three types of adjusting together.

The data indicating the three types of adjusting may be packaged and recorded in the display status recording table included in the storage device of the smart TV. Recording the data to be adjusted in the table may effectively ensure the accuracy of the adjustment, so that the object displayed on the display and thus viewed by the user appears to be closer to the color of the real object.

The first display status for the electronic document may be adjusted based on the adjusting data recorded in the display status recording table. For example, in some situations, only one of the brightness, the chromaticity and the color temperature needs to be adjusted; in some other situations, two of the brightness, the chromaticity and the color temperature needs to be adjusted; and in some still other situations, all of the brightness, the chromaticity and the color temperature needs to be adjusted. The present disclosure is not limited thereto. Further, the parameter is not limited to the above environmental parameters of brightness, chromaticity and color temperature, and there can be other environmental parameters such as those for feeling and smelling.

According to another aspect of the present disclosure, there is provided an electronic device. The electronic device may comprise: a display unit A; a first obtaining module 10 configured to obtain an environmental parameter under an environment where the electronic device is disposed when the display unit is in a first display status, the environmental parameter including at least an environmental color temperature parameter of the environment and configured for adjusting the display status of the display unit; a first determining module 20 configured to determine whether to adjust the display status based on at least the environmental color temperature parameter included in the environmental parameter to get a first determination result; and a first adjusting module 30 configured to adjust the display status from the first display status to a second display status different from the first display status if the first determination result indicates that it is to adjust the display status.

The first obtaining module 10 may comprise an environment detection device provided in the electronic device and configured to obtain the environmental parameter. The environmental parameter may further comprise a brightness parameter and a chromaticity parameter.

The electronic device may further comprise a first simulating module configured to simulate a first status characteristic of a first object displayed on the display unit corresponding to the environmental parameter based on the environmental parameter.

The first simulating module may comprise: a color temperature simulating subunit configured to simulate a first color temperature characteristic of the first object corresponding to the color temperature parameter if the environmental parameter comprises the color temperature parameter; a brightness simulating subunit configured to simulate a first brightness characteristic of the first object corresponding to a brightness parameter if the environmental parameter comprises the brightness parameter; and a chromaticity simulating subunit configured to simulate a first chromaticity characteristic of the first object corresponding to a chromaticity parameter if the environmental parameter comprises the chromaticity parameter.

The first determining module 20 may be configured to determine whether the first status characteristic matches the first display status to get the first determination result. The first determination result may indicate that it is to adjust the display status if there is no matching, and indicate that it is not to adjust the display status if there is matching.

The first adjusting module 30 may comprise: a first obtaining subunit configured to obtain target display adjusting data corresponding to the first status characteristic based on the first status characteristic if the first determining result indicates that it is to adjust the display status; a recording unit configured to record the display adjusting data in a display status recording table in a storage device of the electronic device; and a first adjusting subunit configured to adjust first display adjusting data corresponding to the first display status to the target display adjusting data based on the target display adjusting data in the display status recording table, so that the display status is adjusted from the first display status to the second display status corresponding to the target display adjusting data.

According to one or more embodiments of the present disclosure, there can be the following effects or advantages.

The environmental parameter under the environment where the electronic device is disposed when the display unit is in the first display status may be obtained, wherein the environmental parameter may include at least the environmental color temperature parameter of the environment and configured for adjusting the display status of the display unit. Then, the display status of the electronic device may be adjusted based on the environmental parameter. As a result, it is possible to effectively address the problem that the object displayed on the display can't change with the change of the environmental light, and thus to adaptively adjust the display status the electronic device with the change of the environmental light.

Further, the first status characteristic of the first object displayed on the display unit corresponding to the environmental parameter may be simulated based on the environmental parameter. As a result, it is possible to effectively address the problem that the object displayed on the display can't truly reflect the change of colors as a real object when the environmental light changes, and thus to adjust the display status of the electronic device by simulating the color change of the real object in the environment.

Those skilled in the art will appreciate that the embodiments of the present disclosure may be embodied by methods, systems or computer program products. Therefore, the technology disclosed herein can be implemented in hardware, software, or any combination thereof. The computer program products may comprise computer readable storage medium on which computer executable program codes are recorded. The computer readable storage medium comprises, but not limited to, magnetic disc, CD-ROM, and optical storage.

The embodiments are described with reference to the flowcharts and/or block diagrams. Each operation and/or block in the flowcharts and/or block diagrams or any combination thereof may be implemented by computer program instructions. A general computer, an application specific computer, an embedded processor, or processors of other programmable data processing devices, when executing the computer program instructions, will convert into a machine which achieves function(s) specified by one or more operations in the flowcharts and/or one or more blocks in the block diagram.

The computer program instructions may be stored in computer readable memories which can instruct computers or other programmable data processing devices to operate in a specified manner, resulting in products containing instruction apparatus to achieve function(s) specified by one or more operations in the flowcharts and/or one or more blocks in the block diagram.

The computer program instructions may be loaded onto computers or other programmable data processing devices, so that the computers or other programmable data processing devices may carry out a series of processes, to achieve function(s) specified by one or more operations in the flowcharts and/or one or more blocks in the block diagram.

From the foregoing, it will be appreciated that specific embodiments of the disclosure have been described herein for purposes of illustration, but that various modifications may be made without deviating from the disclosure. In addition, many of the elements of one embodiment may be combined with other embodiments in addition to or in lieu of the elements of the other embodiments. Accordingly, the technology is not limited except as by the appended claims.

We claim:

1. A method for an electronic device with a display unit, the method comprising:

obtaining an environmental parameter under an environment where the electronic device is disposed when the display unit is in a first display status, the environmental parameter including at least one of a color temperature parameter, a brightness parameter and a chromaticity parameter of the environment and configured for adjusting the display status of the display unit;

determining a first object being displayed on the display unit;

simulating and obtaining a first status characteristic of a real object corresponding to the first object based on the environmental parameter;

determining whether the first status characteristic matches the first display status to get a first determination result; and adjusting the display status from the first display status to a second display status different from the first display status if the first determination result indicates no matching, so that when the display unit is in the second display status, a perceived status characteristic of the first object displayed on the display unit is the same as that of the real object corresponding to the first object, wherein on the condition that the environmental parameter comprises the color temperature parameter, simulating and obtaining a first status characteristic of a real object corresponding to the first object comprises simulating and obtaining a first color temperature status characteristic of the real object corresponding to the first object;

on the condition that the environmental parameter comprises the brightness parameter, simulating and obtaining a first status characteristic of a real object corresponding to the first object comprises simulating and obtaining a first brightness status characteristic of the real object corresponding to the first object; and on the condition that the environmental parameter comprises the chromaticity parameter, simulating and obtaining a first status characteristic of a real object corresponding to the first object comprises simulating and obtaining a first chromaticity status characteristic of the real object corresponding to the first object.

2. The method according to claim 1, wherein adjusting the display status from the first display status to the second display status comprises:

obtaining target display adjusting data corresponding to the first status characteristic based on the first status characteristic;

recording the display adjusting data in a display status recording table in a storage device of the electronic device; and adjusting first display adjusting data corresponding to the first display status to the target display adjusting data based on the target display adjusting data in the display status recording table, so that the display status is adjusted from the first display status to the second display status corresponding to the target display adjusting data.

3. An electronic device, comprising:

a display unit;

a first obtaining processor, which is coupled to the display unit, configured to obtain an environmental parameter under an environment where the electronic device is disposed when the display unit is in a first display status, the environmental parameter including at least color temperature parameter, a brightness parameter and a chromaticity parameter of the environment and configured for adjusting the display status of the display unit;

a first determining processor, which is coupled to the first obtaining processor, configured to determine a first object being displayed on the display unit;

a first simulating processor, which is coupled to the first obtaining processor, configured to simulate and obtain, for a first object displayed on the display unit, a first status characteristic of a real object corresponding to the first object based on the environmental parameter;

a second determining processor, which is coupled to the display unit and the first simulating processor, configured to determine whether the first status characteristic matches the first display status to get a first determination result; and a first adjusting processor, which is coupled to the display unit and the first simulating processor, configured to adjust the display status from the first display status to a second display status different from the first display status if the first determination result indicates no matching, so that when the display unit is in the second display status, a perceived status characteristic of the first object displayed on the display unit is the same as that of the real object corresponding to the first object, wherein the first simulating processor comprises:

a color temperature simulating subunit configured to simulate and obtain a first color temperature status characteristic of the real object corresponding to the first object, a brightness simulating subunit configured to simulate and obtain a first brightness status characteristic of the real object corresponding to the first object, and a chromaticity simulating subunit configured to simulate and obtain a first chromaticity status characteristic of the real object corresponding to the first object.

4. The electronic device according to claim 3, wherein the first adjusting processor comprises:

a first obtaining subunit configured to obtain target display adjusting data corresponding to the first status characteristic based on the first status characteristic if the first determining result indicates that it is to adjust the display status;

a recording unit configured to record the display adjusting data in a display status recording table in a storage device of the electronic device; and a first adjusting subunit configured to adjust first display adjusting data corresponding to the first display status to the target display adjusting data based on the target display adjusting data in the display status recording table, so that the display status is adjusted from the first display status to the second display status corresponding to the target display adjusting data.

* * * * *